United States Patent [19]

Ophaug et al.

[11] 4,041,423

[45] Aug. 9, 1977

[54] UNDERVOLTAGE RELEASE FOR CIRCUIT BREAKER

[75] Inventors: Darrell P. Ophaug, Marion; Beryl W. Layton, Cedar Rapids, both of Iowa

[73] Assignee: Square D Company, Park Ridge, Ill.

[21] Appl. No.: 638,482

[22] Filed: Dec. 8, 1975

[51] Int. Cl.[2] ..... H01H 83/12

[52] U.S. Cl. ..... 335/20; 335/166

[58] Field of Search ..... 335/20, 155, 166, 169, 335/170, 171

[56] References Cited

U.S. PATENT DOCUMENTS

| | | | |
|---|---|---|---|
| 3,723,924 | 3/1973 | Shaffer et al. | 335/20 |
| 3,806,846 | 4/1974 | Powell | 335/20 |
| 3,919,674 | 11/1975 | Acampora et al. | 335/20 |

*Primary Examiner*—Harold Broome

*Attorney, Agent, or Firm*—Ernest S. Kettelson; Norton Lesser; Richard T. Guttman

[57] ABSTRACT

An undervoltage trip coil and armature, with a pivotal member biased against and riding on the latch pin of the armature to sense its position. On occurrence of a low voltage condition, a trip lever causes the latch mechanism of the breaker to trip. The pivotal member then interferes with the latch and prevents reset. The undervoltage trip coil is normally energized to normally attract the undervoltage armature. On occurrence of a specified undervoltage condition the armature releases causing the trip lever to trip the latch mechanism and allowing the pivotal member to interfere with the latch of the breaker. During such condition, the breaker cannot be reset until the armature is attracted to the undervoltage coil under proper voltage condition.

14 Claims, 7 Drawing Figures

UNDERVOLTAGE RELEASE FOR CIRCUIT BREAKER

BACKGROUND OF THE INVENTION

This invention relates to the field of undervoltage release mechanisms for circuit breakers.

In addition to mechanism for opening the contacts of a circuit breaker automatically on occurence of short circuits or excessive current conditions, it is often desirable to provide means to open the contacts automatically when an undervoltage condition occurs. Such means typically includes a separate coil and armature to actuate the tripping mechanism on occurrence of a low voltage condition. Ordinarily the armature is attracted to the coil when energized at full voltage, the armature being biased at a selected tension to move away from the coil when voltage supplied to the coil and the circuit breaker drops below a selected amplitude.

Previously known circuit breakers equipped with low voltage mechanism of this type are susceptible to damage if an attempt is made to close the breaker while it is energized with inadequate voltage, or not energized at all. Under such conditions, the low voltage mechanism may allow the breaker to trip during the closing stroke which can damage the breaker.

SUMMARY OF THE INVENTION

It is an object of the invention to prevent latching of a circuit breaker until it is energized with adequate voltage.

It is an object of the invention to provide a trip latch member to sense the position of the undervoltage armature and to prevent the trip bar of the circuit breaker from latching.

It is an object of the invention to prevent tripping of the circuit breaker during the closing stroke by disabling the latch mechanism while the undervoltage coil is energized by inadequate voltage or not energized at all.

DESCRIPTION OF PREFERRED EMBODIMENT

Figure 1:
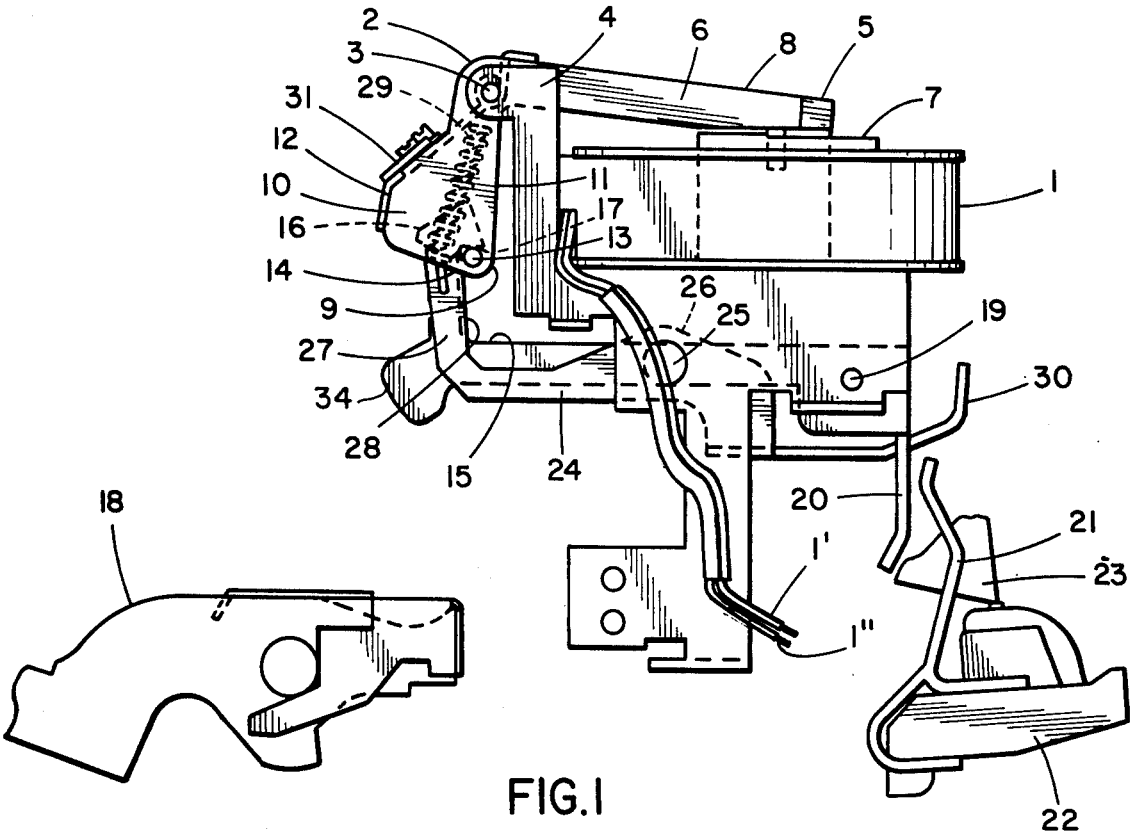
FIG. 1 is a side elevation view of an undervoltage release mechanism in accordance with this invention, partly in phantom and showing selected parts of a circuit breaker in relative position, the undervoltage release mechanism with the coil energized and in set position, the circuit breaker latched and contacts closed.
Figure 2:
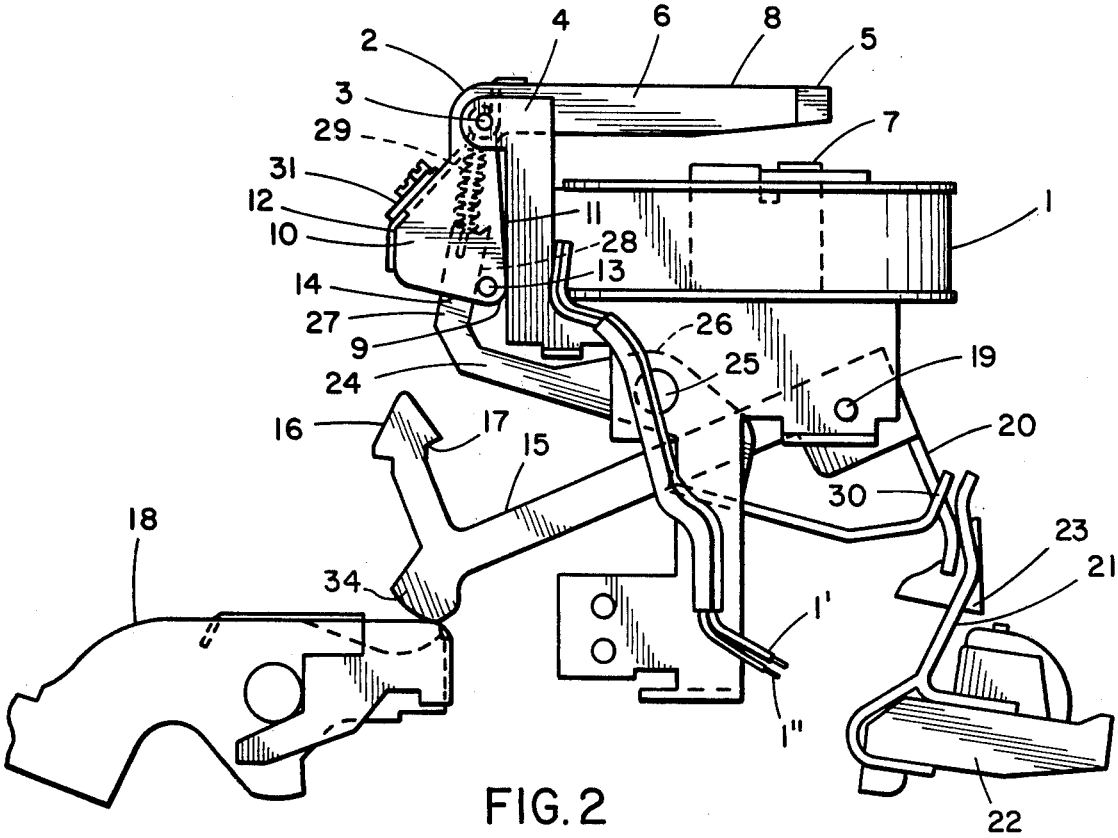
FIG. 2 is a side elevation of FIG. 1 showing the undervoltage release mechanism wherein the coil has released the armature under a low voltage condition, but at the fractional instant before the circuit breaker trips to open the contacts.
Figure 3:
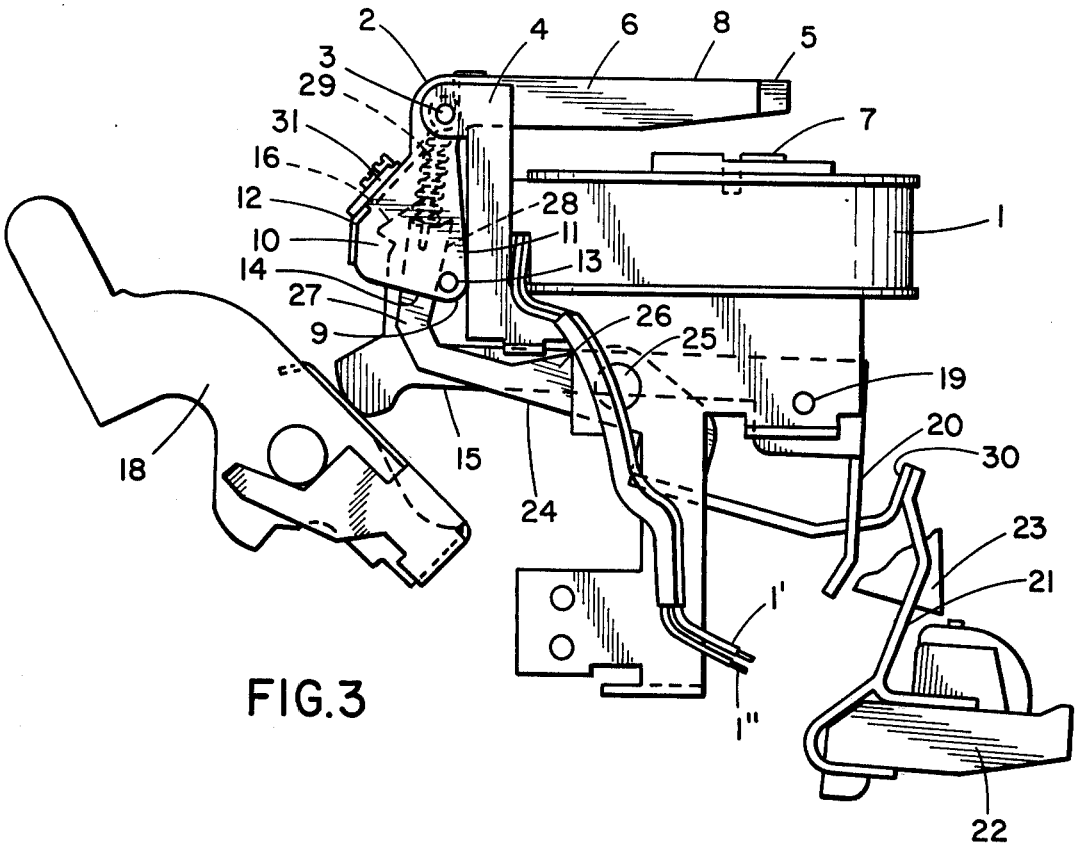
FIG. 3 is a side elevation view of FIG. 2 showing the position of the various parts after the circuit breaker trips and the movable contact blade has moved to contact open position.
Figure 4:
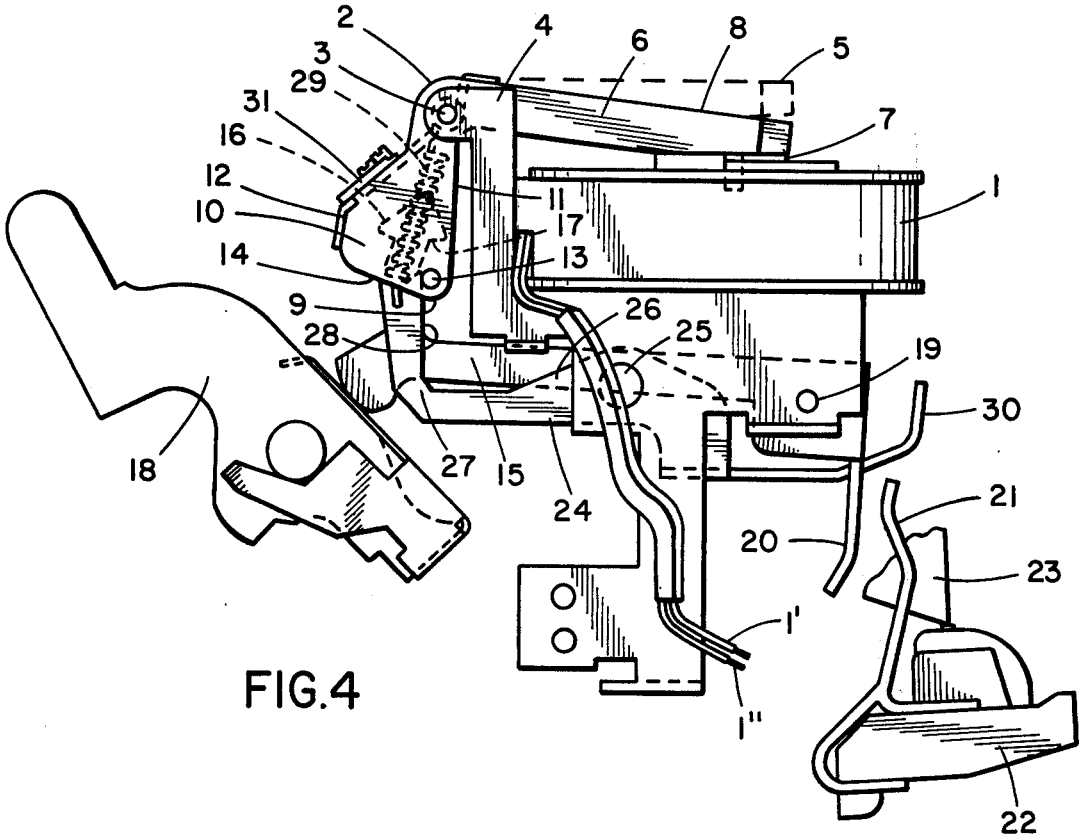
FIG. 4 is a side elevation view of FIG. 3 showing the position of various parts when the coil of the undervoltage release mechanism has been energized at sufficient voltage to attract the armature to contact closed position, with the circuit breaker being latched but before the movable contact blade has been moved to contact closed position.
Figure 5:
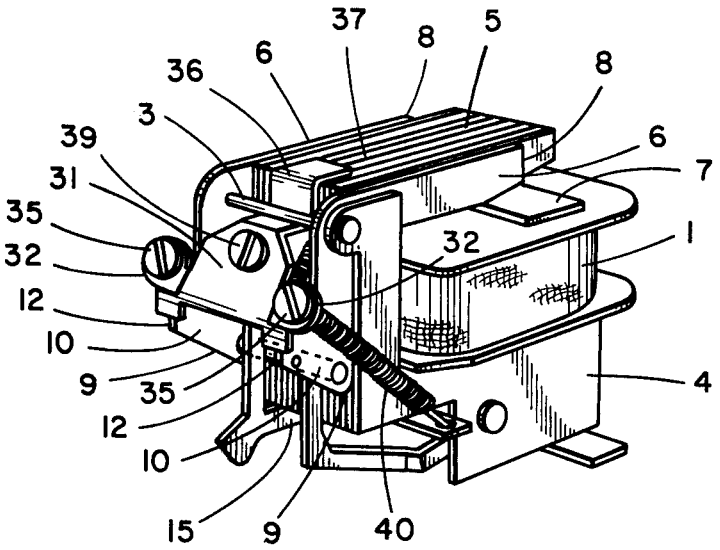
FIG. 5 is a perspective view of the undervoltage release mechanism of this invention looking toward one end.
Figure 6:
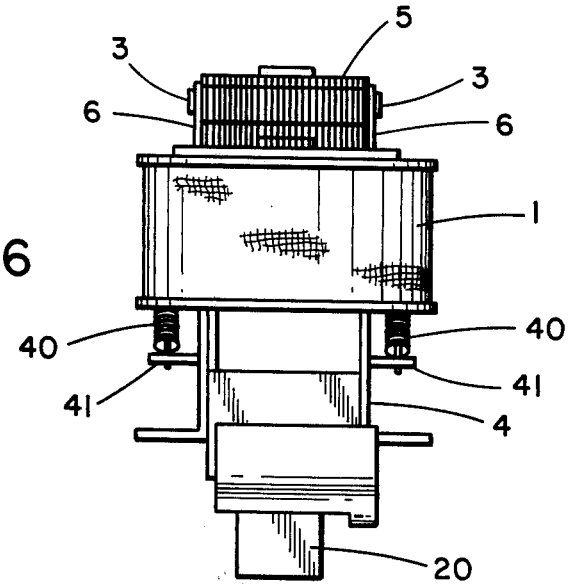
FIG. 6 is an end elevation view of the mechanism in FIG. 5 looking toward the opposite end.
Figure 7:
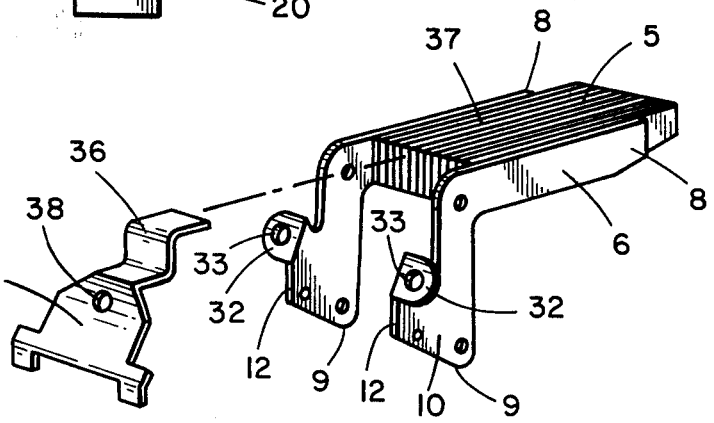
FIG. 7 is an exploded isometric view of the armature and adjustment bracket.

An undervoltage trip mechanism includes trip coil 1 and armature assembly 2 of the clapper type, hingedly mounted by pivot member 3 to the coil frame 4. The trip coil 1 is a connected by leads 1' and 1'' to an energized conductor of the circuit breaker in which the trip coil is mounted.

The armature assembly 2 comprises a laminated core piece 5 mounted between L-shaped side members 6 for movement between open and closed positions with respect to pole face 7 of the trip coil 1, and biased toward the open position away from the pole face 7. Pivot member 3 extends through aligned holes in side members 6 at the junction region thereof between forwardly projecting legs 8 which border opposite sides of laminated core piece 5 and downwardly projecting legs 9. Thus when trip coil 1 is energized at full voltage and the armature assembly pivots on pivot member 3 as laminated coreepiece 5 and side members 6 move downward attracted toward pole face 7, the downwardly projecting legs 9 move laterally and outwardly away from trip coil 1. When voltage on the trip coil is inadequate to hold core piece 5 in the closed position against pole face 7, core piece 5 and side legs 6 move in the biased direction upwardly and away from trip coil 1 while downwardly extending legs 9 move laterally and inwardly toward trip coil 1.

Downwardly extending legs 9 include an expanded leg portion 10 between side edges 11 and 12 which diverge as they extend in the direction away from the junction with forwardly protecting lege 8. A latch pin 13 is mounted at the outer end region 14 of expanded leg portion 10 and extends between the respective legs 9 of L-shaped side members 6.

When the armature assembly 2 is attracted to trip coil 1, latch pin 13 is thereupon carried outwardly away from the trip coil and when the armature assembly is released from trip coil 1 the latch pin 13 is carried inwardly toward the trip coil. When carried outwardly and away from the trip coil, latch pin 13 is in latching position and when carried inwardly toward the trip coil it is in releasing position.

Undervoltage trip lever 15 is pivotally mounted in the breaker for pivotal movement between a set position, whereupon the trip lever head 16 is latchable with latch pin 13, and a trip position downwardly and away from latch pin 13. Trip lever 15 includes a shoulder or latching portion 17 of the head 16 and an elbow portion 34 for bearing engagement against movable contact blade 18, which urges trip lever 15 toward its set position for latching engagement with latch pin 13 when the breaker trips and contact blade 18 moves upwardly to a contact "open" position.

Trip lever 15 is pivotally mounted in the coil frame 4 on a trip lever member 19, with trip lever head 16 and shoulder portion 17 on one side of the pivot and a kicking member 20 which extends downwardly from lever 15 on the other side of pivot 19. The pivot 19 is positioned substantially nearer to kicking member 20 than to the opposite end of trip lever 15. This provides substantially greater leverage at the end on which kicking member 20 is formed. Kicking member 20 is positioned to move between a contact and out-of-contact position with a trip bar clip 21 mounted on trip cross bar 22 of the breaker. When trip lever 15 is in set position and in latching engagement with latch pin 13, kicking member 20 is in the out-of-contact position. At such time, trip coil 1 is energized by adequate voltage to attract and hold the laminated core piece 5 of armature assembly 2 in the closed position. When voltage on trip coil 1 falls below preselected value and laminated core piece 5 is released from trip coil 1, latch pin 13 is caried to its releasing position. Trip lever 15 thereupon pivots downwardly and away from latch pin 13 under the bias in such direction while the kicking member 20 on the other side of pivot 19 is carried to its contact position with trip bar clip 21. This kicks the trip cross bar 22 causing it to rotate to unlatching position away from latch bar 23. The tripping mechanism of the breaker is thereupon released to trip and open the breaker contacts.

A trip latch member 24 is pivotally mounted in the breaker on a trip latch pivot 25. The axis of trip latch pivot 25 and the axis of trip lever pivot 19 are in spaced apart substantially parallel relationship. Trip latch member 24 is mounted to pivot in a plane which is substantially parallel to the plane in which trip lever 15 pivots between trip and set positions, and is spaced apart therefrom to provide clearance and to avoid interference with each other as said trip latch member 24 and trip lever 15 move pivotally in their respective planes.

Trip latch member 24 includes an elongated carrier portion 26, a follower arm 27 extending upwardly from one end of the carrier portion 26 for sliding engagement of follower edge 28 with latch pin 13 on the side outwardly from trip coil 1. A helically coiled spring 29 is anchored at one end to follower arm 27 and extends therefrom to the pivot member 3 around which the other end of spring 29 is anchored. Spring 19 thus biases follower arm 27 of trip latch member 24 in an upwardly direction toward pivot member 3 and in sliding engagement against latch pin 13 along follower edge 28 of follower arm 27.

When the follower arm end of trip latch member 24 moves upwardly toward pivot member 3, the other end thereof on the other side of pivot 25 moves downwardly to a trip bar blocking position. An upstanding wall member 30 is formed at the end of trip latch member 24 to engage and abut against trip bar clip 21 of trip cross bar 22 when it has been rotated to its unlatching position. Wall member 30 thus blocks trip bar clip 21 and trip cross bar 22 in the unlatched position and prevents resetting to a latching position. Thus, as long as the upstanding wall 30 of trip latch member 24 is in blocking relationship with trip bar clip 21, the breaker cannot be reset.

Wall 30 of trip latch member 24 is in such blocking relationship when the armature assembly 2 is in open position, with its core piece 5 biased away from trip coil 1. In such open position, trip coil 1 is either not energized with inadequate voltage. Trip lever 15 has kicked the trip cross bar 22 to unlatching position causing the breaker to trip on occurrence of such under voltage condition. At the same time trip latch member 24 is pivoted to the blocking position as described, so the breaker cannot be reset as long as such under-voltage condition exists.

When adequate voltage is supplied to trip coil, it attracts armature assembly 2 to the closed position. As the armature core piece 5 moves downwardly to contact pole face 7 of the trip coil, the armature legs 9 and expanded portions 10 carrying latch pin 13 move laterally outwardly away from trip coil 1. Follower arm 27 of trip latch member 24, and its follower edge 28 bearing against latch pin 13, are thus urged outwardly. The follower edge 28 provides a cam surface against latch pin 13 to sense the position of armature assembly 2 and to cause follower arm 27 to move downwardly as latch pin 13 is moved outwardly. This forces the trip latch member 24 to rotate on pivot 25. The opposite end of trip latch member 24 carrying blocking wall member 30 is at such time moved upwardly and out of engagement with trip bar clip 21. The trip cross bar 22 is thus free to latch and the breaker can be reset.

In addition, when armature assembly 2 is attracted to closed position by energizing trip coil 1 with adequate voltage thus moving latch pin 13 outwardly away from trip coil 1, the trip lever 15 will now latch against the pin 13. The head portion 16 of the trip lever at this time will be in the far upward position by virtue of movable contact blade 18 (which is still open) bearing against the elbow portion 34 of trip lever 15. When the breaker is now reset moving the movable contact blade away from elbow portion 34, trip lever 15 under bias begins to rotate in the direction that moves its head portion 16 downward. However, since latch pin 13 is now in latching position, the latching portion 17 of head 16 latches against latch pin 13 thus holding trip lever 15 in its set position as long a strip coil 1 is energized with adequate voltage. It is thus possible to reset the breaker, and it will remain in such condition until an undervoltage condition again appears at trip coil 1.

The undervoltage release mechanism of this invention may include means to adjust the gap between armature core piece 5 and pole face 7 of the trip coil. A bracket 31 is mounted to extend between the expanded portions 10 of downwardly projecting legs 9 of the armature assembly 2, the bracket 31 being positioned against respective edges 12 of the expanded portions 10. Outwardly extending ears 32 are formed to project from the edge of each respective edge 12, to receive screws 35.

The bracket 31 includes a forwardly projecting arm 36 in bearing engagement against the upper surface 37 of the laminated core piece 5 of the armature assembly. A tapped aperture 38 is provided centrally of the body portion of bracket 31, and a set screw 39 is threaded therein to bear against the coil frame 4. As screw 39 is rotated in aperture 38 to move longitudinally in the direction toward coil frame 4, the expanded leg portions 10 are urged outwardly away from coil frame 4 which causes the armature assembly to pivot member 3 and moving the laminated core piece 5 closer to pole face 7 of the trip coil thus narrowing the gap.

Helically wound springs 40 are provided, which are anchored at one end to expanded leg portions with a screw that extends through hole 33 in outwardly extending ears 32 and the other end to lugs 41 extending outwardly from the bottom edges of coil frame 4. Such springs 40 bias expanded leg portions 10 toward the coil frame 4, thereby biasing the core piece 5 portion of the armature assembly toward the open position away from the pole face 7 of trip coil 1. Thus, when screw 39 through bracket 31 and bearing against coil frame 4 is rotated in the other direction to move longitudinally away from coil frame 4, the springs 40 bias expanded leg portions 10 toward the frame 4 and core piece 5 farther away from pole face 7 of the coil. Thus by rotating screw 39 in such direction the gap is widened.

By rotating screw 39 to adjust the gap between core piece 5 of the armature assembly and pole face 7 of the trip coil, the undervoltage trip mechanism can be adjusted to operate at the full required voltage or at a given percentage of full voltage. For example, with the gap adjusted to its widest position the armature will be attracted to the trip coil at the full required voltage, but by narrowing the gap somewhat the armature will be attracted to the coil at somewhat less than full required voltage. A desirable pick-up point, for example, is 85% of full voltage. In accordance with this invention, the undervoltage trip mechanism may thus be adjusted so the armature will be attracted to the trip coil at any point between the full voltage selected and 85% of such voltage.

We claim:

1. An undervoltage release mechanism for a circuit breaker having main latch means and main contact opening means, comprising coil means connected in said circuit breaker in series with an electrical source for energization by said source, armature means operatively associated with said coil means; for movement by said coil means between an open and a closed position in accordance with the state of energization of said coil means, undervoltage trip means operatively associated with said armature means and with said main latch means for movement between a set position to permit said main latch means for movement between a set position to permit said main latch means to latch said main contact opening means when said armature means is in one of its said positions and a trip position to trip said main latch means for releasing said contact opening means when said armature means is in the other of its said positions, and main latch restraint means operatively assoicated with said armature means and with said main latch means for automatic movement by said armature means and independently of said undervoltage trip means to a released positon to permit said main latch means to latch said contact opening means when said armature means is in one of its said position and to a restraint position to restrain said main latch means from latching said contact opening means when said armature means is in the other of its said positions.

2. An undervoltage release mechanism as set forth in claim 1, wherein said undervoltage trip means is moved to its said set position when said armature means is in its said closed position.

3. An undervoltage release mechanism as set forth in claim 1, wherein said undervoltage trip means is moved to its said set position and said main latch restraint means is moved to its said released position when said armature means is in its said closed position.

4. An undervoltage release mechanism as set forth in claim 1, wherein said undervoltage trip means is moved to its said trip position and said main latch restraint means is moved to its said restraint position when said armature means is in its said open position.

5. An undervoltage release mechanism as set forth in claim 1, wherein said coil means in directly responsive to changes in voltage amplitude from said electrical source, and adjustment means to adjust the operative point at which said armature means will move to said closed and said open positons relative to voltage amplitude.

6. An undervoltage release mechanism as set forth in claim 5, wherein said adjustment means is adjustable to set said operative point any amplitude within a range between full source voltage and 85% of such voltage.

7. An undervoltage release mechanism for a circuit breaker having main latch means and main contact opening means comprising coil means connected in said circuit breaker in series with an electrical source, armature means operatively associated with said coil means for movement between an open and a closed position, undervoltage trip means operatively associated with said armature means and with main latch means for movement between a set position to permit said main latch means to latch when said armature means is in one of its said positions and a trip position to trip said main latch means when said armature means is in the other of its said positions, and main latch restraint means operatively associated with said armature means and with said main latch means for movement between a released position to permit said main latch means to be relatched when said armature means is in one of its said positions and a restraint position to restrain said main latch means from being relatched when said armature means is in the other of its said positions, said armature means comprises an L-shaped armature assembly, including a first leg and a second leg extending at substantially a right angle to each other, said coil means comprises a coil spaced from and bounded at one side and one end by said first and second legs respectively of said L-shaped armature assembly, a pole face at said one end of said coil, a magnet core piece carried by the said second leg of said armature assembly bounding said one end of said coil, said core piece being positioned for contact with said pole face when said coil is adequately energized and said armature assembly is attracted to said closed position, undervoltage latch means associated with said first leg of said L-shaped armature assembly and said undervoltage trip means to latch said undervoltage trip means in its said set position when said armature is in its said closed position.

8. An undervoltage release mechanism as set forth in claim 7, wherein said undervoltage latch means is associated additionally with said main latch restraint means to guide said main latch restraint means between its said released position when said armature assembly is in closed position and its said restraint position when said armature assembly is in open position.

9.

An undervoltage release mechanism as set forth in claim 7, including adjustment means to adjust the operative point at which said armature means will move to said closed and said open positions relative to voltage amplitude, said adjustment means comprising a bracket mounted transversely on said first leg of said L-shaped armature assembly, a screw threaded said bracket having a shank bearing against a fixed member of said circuit breaker, said screw shank being movable longitudinally in relation to said bracket toward said fixed member when rotated in a first direction and away from said fixed member when rotated in the opposite second direction, said first leg of said L-shaped armature assembly being biased toward said fixed member, whereby said second leg of said L-shaped armature assembly is moved closer to said pole face of said coil when said screw is rotated in said first direction and said second leg is moved farther away from said pole face when said screw is rotated in said second direction.

10. An undervoltage release mechanism as set forth in claim 9, wherein said undervolage trip means comprises a lever having an elongated body portion pivotally mounted in the circuit breaker, a head member at one end region of said elongated body portion positioned for engagment with said undervoltage latch means when said lever of said unervoltage trip means is in its said set position, a kicking member at said opposite end region of said elongated body portion for tripping engagement with said main latch means when said lever is in its said trip position.

11. An undervoltage release mechanism as set forth in claim 10, wherein said main latch restraint means comprises a lever having an elongated body portion pivotally mounted in the circuit breaker, the pivotal axes of said lever of said undervoltage trip means and lever of said main latch restraint means being in spaced apart substantially parallel relationship, said lever of said latch restraint means being mounted to pivot in a plane which is substantially parallel to the plane in which said lever of said undervoltage trip means pivots and spaced apart therefrom to provide clearance for said levers to pivot along side of each other, a follower arm at one end region of said elongated body portion of said lever of said main latch restraint means for sliding engagement with said undervoltage latch means on said first leg of said L-shaed armature assembly, said follower arm being biased in the direction of its movement when said main latch restraint means moves to its said restraint position, said undervoltage latch means bearing against said follower arm in a camming relationship to move said follower arm in the opposite direction when said armature assembly is attracted to the closed position, bearing member at the opposite end region of said elongated body portion of said lever of said main latch restraint means, said bearming member being positioned for engagment against said main latch means to prevent latching thereof when said main latch restraint means is in its said restraint position, said bearing member being pivotally moved away from said main latch means to permit latching thereof when said follower arm moves oppositely of its direction of bias as said armature assembly is attracted to its closed position.

12. An undervoltage release mechanism as set forth in claim 11, wherein said L-shaped armature assembly includes a pair of L-shaped side members in spaced apart parallel relationship having respective first and second legs, said core piece being mounted between said respective second legs of said L-shaped side members, said undervoltage latch means comprising a pin extending between said respective first legs of said L-shaped side members and near the end region thereof remote from the junction with said second legs.

13. An undervoltage release mechanism as set forth in claim 10, wherein said lever of said undervoltage trip means is pivotally mounted in the circuit breaker at a point on its said elongated body portion substantially nearer to said end region having said kicking member thereat, whreby substantially greater leverage is provided at said end region to more positively assure tripping when said armature means moves to its open position.

14. An undervoltage release mechanism as set forth in claim 10, wherein said lever of said undervoltage trip means includes a shoulder portion at said end region having said head member, said shoulder portion being positioned for engagement with a movable contact blade of a circuit breaker in which it is mounted and for movement to the set position of said undervoltage trip means by said movable contact when being tripped open.

* * * * *